US005158710A

United States Patent [19]

VanEenam

[11] Patent Number: 5,158,710

[45] Date of Patent: Oct. 27, 1992

[54] AQUEOUS CLEANER/DEGREASER MICROEMULSION COMPOSITIONS

[75] Inventor: Donald N. VanEenam, Des Peres, Mo.

[73] Assignee: Buckeye International, Inc., St. Louis, Mo.

[21] Appl. No.: 640,080

[22] Filed: Jan. 11, 1991

Related U.S. Application Data

[63] Continuation of Ser. No. 373,910, Jun. 29, 1989, abandoned.

[51] Int. Cl.[5] ..... C11D 3/43; C11D 7/50; C11D 7/52

[52] U.S. Cl. ..... 252/539; 252/547; 252/529; 252/162; 252/171; 252/172; 252/173; 252/DIG. 14; 252/551; 252/558; 252/528; 252/555; 252/532; 252/139

[58] Field of Search ..... 252/171, 165, 170, DIG. 14, 252/173, 158, 162, 164, 172, 139, 539, 547, 529, 558, 548

[56] References Cited

U.S. PATENT DOCUMENTS

| | | | |
|---|---|---|---|
| 4,414,128 | 11/1983 | Goffinet | 252/111 |
| 4,561,991 | 12/1985 | Heebots et al. | 252/118 |
| 4,606,840 | 8/1986 | Gautier et al. | 252/171 |
| 4,758,377 | 7/1988 | Inding | 252/556 |
| 4,769,172 | 9/1988 | Siklosi | 252/153 |
| 4,826,618 | 5/1989 | Borseth et al. | 252/174.22 |
| 4,909,962 | 3/1990 | Clark | 252/171 |
| 4,919,839 | 4/1990 | Durbut et al. | 252/171 |
| 4,921,629 | 5/1990 | Malihi et al. | 252/170 |

*Primary Examiner*—Prince Willis, Jr.
*Assistant Examiner*—James Silbermann
*Attorney, Agent, or Firm*—Senniger, Powers, Leavitt & Roedel

[57] ABSTRACT

The disclosure concerns stable, aqueous cleaner/degreaser compositions formulated in the form of true microemulsions and containing a builder component. The microemulsions comprise (a) at least one sparingly water soluble organic solvent having specified characteristics including having a water solubility in the range of approximately 0.2 to approximately 6 weight percent and being present in an amount exceeding its aqueous solubility; (b) a builder; (c) a solubilizing additive consisting of from approximately 0.1 to approximately 100 weight percent of a surfactant and from 0 to approximately 99.9 weight percent of a coupler, the solubilizing additive being present in an amount not substantially exceeding the amount required to transform the combination of the organic solvent and builder from the form of a true macroemulsion to the form of a microemulsion and less than that required to form a true solution; and (d) water.

40 Claims, No Drawings

AQUEOUS CLEANER/DEGREASER MICROEMULSION COMPOSITIONS

This is a continuation, of application Ser. No. 373,910, filed Jun. 29, 1989 now abandoned.

BACKGROUND OF THE INVENTION

This invention relates to cleaner/degreaser compositions and, more particularly, to stable, aqueous, builder-containing cleaner/degreaser compositions in the form of true microemulsions which exhibit enhanced cleaning and degreasing capability.

Heretofore, all of the conventional and available ready to use and concentrated water soluble, dilutable cleaner/degreaser compositions have expediently contained infinitely or highly water soluble organic solvents such as butyl cellosolve (ethylene glycol monobutyl ether), butyl carbitol (diethylene glycol monobutyl ether), ethyl carbitol, propylene glycol monomethyl ether, dipropylene glycol monomethyl ether or isopropanol together with anionic or nonionic surfactants and conventional adjuvants such chelants, builders, perfumes, dyes, pH adjustors, etc., these components falling generally within the following compositional wt. % ranges:

| | |
|---|---|
| 2-10% | Water soluble solvent(s) |
| 1-3% | Anionic or nonionic surfactant |
| 0.1-3% | Adjuvants |
| QS | Water |
| 100.0% | |

Such conventional compositions are generally deficient in cleaning action and especially in heavy duty grease, oil, wax, etc. cutting action, often smell objectionably strongly of volative solvent and can sometimes present conbustability problems in concentrated form. They also tend to be harsh on the hands and to defat the skin. Further, heavy scrubbing, mopping or other mechanical action is generally required to attain the desired cleaning/degreasing action, especially where excessive soilant buildup has occurred. Most, even in their concentrated form, are ineffective in their capability to remove graffiti or the like.

In my copending, coassigned application Ser. No. 373,813, filed Jun. 29, 1989, and entitled Improved Aqueous Cleaner/Degreaser Compositions, I disclose stable, aqueous cleaner/degreaser compositions which are formulated in the form of totally water soluble solutions. Such compositions comprise (a) at least one sparingly water soluble organic solvent having certain defined characteristics; (b) a solubilizing additive consisting of from 0.1 to approximately 100 weight percent of a surfactant and from 0 to approximately 99.9 weight percent of a coupler, the solubilizing additive being present in an amount not exceeding approximately tenfold that required to completely solubilize the organic solvent; and (c) water. While such compositions exhibit markedly superior cleaning/degreasing efficacy over that achievable with compositions containing infinitely water soluble organic solvents, problems are encountered in incorporating builders therein to further enhance their cleaning/degreasing capability due to the "salting out" characteristics of conventional builders.

There is a need, therefore, for improved builder-containing, aqueous cleaner/degreaser compositions which permit still further improvements in cleaner/degreasing activity.

SUMMARY OF THE INVENTION

Among the several objects of the invention may be noted the provision of stable, aqueous cleaner/degreaser compositions containing builders which boost the cleaning/degreasing action of such compositions; the provision of such compositions which are formulated in the form of stable microemulsions; the provision of compositions of this type which incorporate organic solvents of inherently limited aqueous solubility; the provision of such compositions which are nontoxic, nonhazardous in use and exhibit a low level of odor; the provision of such compositions which avoid soil redeposition and inhibit metal corrosion; and the provision of such improved builder-containing compositions which may be readily formulated from available components. Other objects and features will be in part apparent and in part pointed out hereinafter.

Briefly, the present invention is directed to stable, aqueous cleaner/degreaser compositions which are formulated in the form of true microemulsions. The compositions comprise:

(a) at lease one sparingly water soluble organic solvent characterized by:

(i) having a water solubility in the range of approximately 0.2 to approximately 6 weight percent;

(ii) not being a hydrocarbon or halocarbon;

(iii) having one or more similar or dissimilar oxygen, nitrogen, sulfur or phosphorous containing functional groups;

(iv) being a solvent for hydrophobic soilants; and (v) being present in an amount exceeding its aqueous solubility.

(b) a builder;

(c) a solubilizing additive consisting of from approximately 0.1 to approximately 100 weight percent of a surfactant and from 0 to approximately 99.9 weight percent of a coupler, said solubilizing additive being present in an amount not substantially exceeding the amount required to transform the combination of said organic solvent and said builder from the form of a true macroemulsion to the form of a microemulsion and less than that required to form a true solution; and (d) water.

The compositions of the invention exhibit improved cleaner/degreaser efficacy over compositions which contain no builder component.

DESCRIPTION OF THE PREFERRED EMBODIMENTS

In accordance with the present invention, it has been found that improved builder-containing aqueous cleaner/degreaser compositions can be formulated in the form of stable microemulsions by combining at least one sparingly water soluble organic solvent having certain characteristics and being present in an amount exceeding its aqueous solubility with a builder, a solubilizing additive and water, the solubilizing additive being present in an amount not substantially exceeding the amount required to transform the combination of said organic solvent and said builder from the form of a true macroemulsion to the form of a microemulsion and less than that required to form a true solution. Surprisingly, as demonstrated by the experimental data presented hereinafter, it has been discovered that the incorporation of builders into such compositions formulated as microemulsions boosts or enhances the cleaning/degreasing efficacy as compared to compositions containing no builder component. As indicated, it is essential to the formation of microemulsion compositions in accordance with the present invention that the solubilizing additive be present in an amount not substantially exceeding that required to transform the combination of the organic solvent and builder from the form of a true macroemulsion to the form of a microemulsion and less than that required to form a true solution. Whereas such a macroemulsion is opaque, the microemulsions of the invention are clear and exhibit the Tyndall effect. It is believed that the aqueous phase of the microemulsions contains the dissolved builder. Due to the limited aqueous solubility of the organic solvents employed in the practice of the invention, it is unexpected that true microemulsions are formed.

The incorporation of a builder component in the microemulsion compositions of the invention provides additional advantages not conferred by cleaning/degreasing compositions which contain no builder component. Thus, such microemulsions not only achieve an enhanced cleaning/degreasing efficacy but, moreover, they avoid soil redeposition and generally inhibit metal corrosion. Accordingly, the compositions of the invention are particularly useful for cleaning/degreasing metallic surfaces. Further, such microemulsions are more cost effective in their formulation since they generally contain lower amounts of the organic solvent component than do non-builder formulations. Also, the present invention permits the practical and effective use of normally hydrophobic (oleophilic) solvents in builder-containing compositions, which solvents have great affinity for and dissolving action against oleophilic soilants.

For use in the present invention, the sparingly water soluble organic solvent must have the following characteristics:

(a) it must have limited water solubility in the range of approximately 0.2 to 6 weight percent;
(b) it must not be a hydrocarbon or halocarbon;
(c) it must have one or more similar or dissimilar oxygen, nitrogen, sulfur or phosphorous containing functional groups;
(d) it must be a solvent for hydrophobic soilants; and
(e) it must be present in an amount exceeding its limited aqueous solubility. Organic solvents meeting these criteria provide superior cleaning/degreasing action when formulated in accordance with the invention.

The principal classes of organic solvents from which useful organic solvents may be selected include esters, alcohols, ketones, aldehydes, ethers and nitriles. These will generally contain one or more of the desired similar or dissimilar functional groups listed above. Examples of organic solvents containing similar functional groups from among those listed above include diethyl gluterate (2 ester groups), phenacyl acetone (2 keto groups), diethylethyl phosphonate (2 phosphonate ester groups), ethylenedipropionate (2 ester groups), decylene glycol (2 hydroxyl groups), m-dimethoxybenzene (2 ether groups), adiponitrile (2 nitrile groups), ethylene glycol dibutyl ether (2 ether groups), and diethyl-o-phthalate (2 ester groups). Among organic solvents containing dissimilar functional groups from among those listed above may be mentioned 2-phenoxyethanol (hydroxy, ether groups), 1-phenoxy-2-propanol (hydroxy, ether groups), N-phenylmorpholine (amino, ether groups), isopropylacetoacetate (keto, ester groups), o-methoxybenzyl alcohol (ether, hydroxy groups), 4'-methoxyacetophenone (ether, ketone groups), o-nitrophenetole (nitro, ether groups), 2-hexoxyethanol (hydroxy, ether groups), ethylcyanoacetoacetate (cyano, keto, ester groups), p-anisaldehyde (ether, aldehyde groups), polypropylene glycol 1200 (ether, hydroxyl groups), n-butoxy acetate (ether, ester groups), and 2-phenylthioethanol (thioether, hydroxyl groups).

In addition to the criteria listed above, it is also desirable but not essential that the organic solvent have a relatively low volatility or high flash point, exhibit a low level of odor, be chemically stable, nontoxic, nonhazardous and commercially available.

The sparingly water soluble organic solvents which may be employed in the practice of the present invention (and comprising some of the solvents listed above) together with their aqueous ambient temperature solubility in wt. % include 2-phenoxyethanol (2.3) (marketed under the trade designation "Dowanol EPh"), 1-phenoxy-2propanol (1.1) (marketed under the trade designation "Dowanol PPh") β-phenylethanol (1.6), acetophenone (0.5), benzyl alcohol (4.4), benzonitrile (1.0), n-butyl acetate (0.7), n-amyl acetate (0.25), benzaldehyde (0.3), N,N-diethylaniline (1.4), diethyl adipate (0.43), dimethyl-o-phthalate (0.43), n-amyl alcohol (2.7), N-phenylmorpholine (1.0), n-butoxyethyl acetate (EB acetate) (1.1), cyclohexanol (4.2), polypropylene glycol 1200 (2), cyclohexanone (2.3), isophorone (1.2), methylisobutyl ketone (2.0), methylisoamyl ketone (0.5), tri-n-butylphosphate (0.6), 1-nitropropane (1.4), nitroethane (4.5), dimethyl esters of mixed succinic, glutaric and adipic acids (5.7) (marketed under the trade designation "DBE ester" by DuPont), diethyl glutarate (0.88), and diethyl malonate (2.08). As will be apparent to those skilled in the art, the above-listed sparingly water soluble organic solvents are merely illustrative and various other solvents meeting the criteria set out above may also be utilized in the practice of the invention. Because of their performance characteristics, lack of odor, low volatility/high flash point, chemical stability and availability, 2-phenoxyethanol and 1-phenoxy-2-propanol are the preferred organic solvents of choice. N-butoxyethyl acetate (EB acetate) and the dimethyl esters of mixed succinic, glutaric and adipic acids are also among the preferred organic solvents.

As indicated, a number of otherwise potent organic solvents having an aqueous solubility of less than approximately 0.2 weight percent such as 2-(2-ethylhexoxy)ethanol (2-ethylhexyl cellosolve) having an aqueous solubility of only 0.095 wt. %, and 2,6-dimethyl -4-heptanone (diisobutyl ketone) (aq. sol. 0.05 wt. %), and organic solvents having an aqueous solubility in excess of approximately 6 weight percent such as propylene glycol monomethyl ether acetate (aq. sol. 16.5 wt. %), ethylene glycol diacetate (aq. sol. 14.3 wt. %), propylene carbonate (aq. sol. 19.6 wt. %) and N-methyl pyrrolidone (infinite aq. sol.) are not useful in the practice of the invention.

In formulating the stable, aqueous cleaner/degreaser compositions of the invention in the form of microemulsions, an organic solvent meeting the required criteria is combined with a builder, a solubilizing additive and water. As is known to those skilled in the art, a builder is a material that enhances or maintains the cleaning efficiency of surfactants and functions by inactivating water hardness, supplying alkalinity to assist cleaning, providing buffering to maintain alkalinity, preventing removed soil from redepositing during washing, and emulsifying oily and greasy soils. Any of the conventional builders known to the art may be used in the practice of the invention. These include silicates such as alkali metal silicates and metasilicates, alkali metal hydroxides, alkali metal carbonates, bicarbonates and sesquicarbonates, phosphates such as alkali metal phosphates, pyrophosphates, tripolyphosphates, hexametaphosphates and tetraphosphates, borax and alkali metal borates. Among specific builders which may be used in the practice of the invention may be mentioned sodium hydroxide, sodium metasilicate, sodium silicate ($Na_2O:2SiO_2$ or $Na_2O:3SiO_2$), sodium carbonate, sodium sesquicarbonate, sodium bicarbonate, borax, trisodium phosphate, tetrasodium pyrophosphate, sodium tripolyphosphate, sodium hexametaphosphate, sodium tetraphosphate, and sodium perborate. Other builders known to the art may also be used. The builder component will generally constitute from approximately 0.25 to 10.0 wt. % of the total composition.

The solubilizing additive component of the compositions of the invention consists of from approximately 0.1 to approximately 100 weight percent of a surfactant and from 0 to approximately 99.9 weight percent of a coupler and the solubilizing additive is present in the formulated composition in an amount necessary to form a microemulsion, i.e. an amount not substantially exceeding the amount required to transform the combination of the organic solvent and builder components from the form of a true macroemulsion to the form of a microemulsion and less than that required to form a true solution. Preferably, the amount of solubilizing additive employed is just sufficient to form a microemulsion. The amount of solubilizing additive (surfactants or surfactant plus coupler) required to effect the formation of a microemulsion will vary depending upon the particular organic solvent and builder employed and can readily be determined by simple experimentation in each instance.

The solubilizing additive used in the practice of the invention may consist of a surfactant or a surfactant in combination with a coupler. As used herein, the term "coupler" is intended to mean a hydrotrope or a substance that increases the solubility in water of another material which is only partially water soluble, such as organic solvents or surfactants. In some instances, the use of a surfactant alone will suffice to render the organic solvent component of the compositions just completely (microcolloidally) soluble while in other instances the use of a surfactant in combination with a coupler may be utilized to achieve the desired microcolloidal solubilization of the organic solvent, i.e. microcolloidal solubilization meaning to transform the combination of the organic solvent and builder from a true macroemulsion to the form of a microemulsion. Whether or not a surfactant alone or the combination of a surfactant and coupler is to be used is dependent upon the particular organic solvent and surfactant employed and can readily be determined in each particular case by simple experimentation. The surfactant used may be an anionic, nonionic, cationic or amphoteric surfactant, and the use of anionic or nonionic surfactants is generally preferred, especially for hard surface cleaning/degreasing. Illustrative anionic surfactants for use in the invention include dodecylbenzene sulfonic acid, sodium dodecylbenzene sulfonate, potassium dodecylbenzene sulfonate, triethanolamine dodecylbenzene sulfonate, morpholinium dodecylbenzene sulfonate, ammonium dodecylbenzene sulfonate, isopropylamine dodecylbenzene sulfonate, sodium tridecylbenzene sulfonate, sodium dinonylbenzene sulfonate, potassium didodecylbenzene sulfonate, dodecyl diphenyloxide disulfonic acid, sodium dodecyl diphenyloxide disulfonate, isopropylamine decyl diphenyloxide disulfonate, sodium hexadecyloxypoly (ethyleneoxy)(10)ethyl sulfonate, potassium octylphenoxypoly(ethyleneoxy)(9) ethyl sulfonate, sodium alpha $C_{12-14}$ olefin sulfonate, sodium hexadecane-1 sulfonate, sodium ethyl oleate sulfonate, potassium octadecenylsuccinate, sodium oleate, potassium laurate, triethanolamine myristate, morpholinium tallate, potassium tallate, sodium lauryl sulfate, diethanolamine lauryl sulfate, sodium laureth (3) sulfate, ammonium laureth (2) sulfate, sodium nonylphenoxypoly(ethyleneoxy)(4) sulfate, sodium diisobutylsulfosuccinate, disodium laurylsulfosuccinate, tetrasodium N-laurylsulfosuccinimate, sodium decyloxypoly(ethyleneoxy(5-)methyl)carboxylate, sodium octylphenoxypoly(ethyleneoxy(8)methyl)carboxylate, sodium mono decyloxypoly(ethyleneoxy)(4)phosphate, sodium di decyloxypoly(ethyleneoxy)(6)phosphate, and potassium mono/di-octylphenoxypoly(ethyleneoxy)(9)phosphate. Other anionic surfactants known in the art may also be employed.

Among the useful nonionic surfactants which may be employed may be mentioned octylphenoxypoly(ethyleneoxy)(11)ethanol, nonylphenoxypoly(ethyleneoxy)(13)ethanol, dodecylphenoxypoly(ethyleneoxy)(10)ethanol, polyoxyethylene (12) lauryl alcohol, polyoxyethylene (14) tridecyl alcohol, lauryloxypoly(ethyleneoxy)(10)ethyl methyl ether, undecylthiopoly(ethyleneoxy)(12)ethanol, methoxypoly(oxyethylene(10)/(oxypropylene(20))-2-propanol block copolymer, nonyloxypoly(propyleneoxy)(4)/(ethyleneoxy)(16)ethanol, dodecyl polyglycoside, polyoxyethylene (9) monolaurate, polyoxyethylene (8) monoundecanoate, polyoxyethylene (20) sorbitan monostearate, polyoxyethylene (18) sorbitol monotallate, sucrose monolaurate, lauryldimethylamine oxide, myristyldimethylamine oxide, lauramidopropyl-N,N-dimethylamine oxide, 1:1 lauric diethanolamide, 1:1 coconut diethanolamide, 1:1 mixed fatty acid diethanolamide, polyoxyethylene(6)lauramide, 1:1 soya diethanolamidopoly(ethyleneoxy)(8) ethanol, coconut diethanolamide, "modified", and coconut diethanolamide, "long chain modified". Other known nonionic surfactants may likewise be used.

Illustrative useful cationic surfactants include a mixture of n-alkyl ($C_{12}$ 50%, $C_{14}$ 30%, $C_{16}$ 17%, $C_{18}$ 3%) dimethyl ethylbenzyl ammonium chlorides, hexadecyltrimethylammonium methosulfate, didecyldimethylammonium bromide and a mixture of n-alkyl (68% $C_{12}$, 32% $C_{14}$) dimethyl benzyl ammonium chlorides. Similarly useful amphoteric surfactants include cocamidopropyl betaine, sodium palmityloamphopropionate, N-coco beta-aminopropionic acid, disodium N-lauryliminodipropionate, sodium coco imidazoline amphoglycinate and coco betaine. Other cationic and amphoteric surfactants known to the art may also be utilized.

The preferred surfactants for general use in the practice of the invention include dodecylbenzenesulfonic acid and the sodium, potassium, triethanolamine, morpholinium, ammonium and isopropylamine salts thereof, and morpholinium tallate.

The couplers which may be utilized in the practice of the invention include sodium benzene sulfonate, sodium toluene sulfonate, sodium xylene sulfonate, potassium ethylbenzene sulfonate, sodium cumene sulfonate, sodium octane-1-sulfonate, potassium dimethylnaphthalene sulfonate, ammonium xylene sulfonate, sodium n-hexyl diphenyoxide disulfonate, sodium 2-ethylhexyl sulfate, ammonium n-butoxyethyl sulfate, sodium 2-ethylhexanoate, sodium pelargonate, sodium n-butoxymethyl carboxylate, potassium mono/di phenoxyethyl phosphate, sodium mono/di n-butoxyethyl phosphate, triethanolamine trimethylolpropane phosphate, sodium capryloamphopropionate, disodium capryloiminodipropionate, and sodium capro imidazoline amphoylycinate. Certain water-soluble solvents known to the art as couplers such as propylene glycol ethers (e.g. tripropyleneglycol monomethyl ether) can be used in the practice of the invention, but cannot be substituted for the sparingly water soluble organic solvent component. Additional couplers or hydrotropes known to the art may also be utilized.

In regard to the solubilizing additive component of the compositions of the invention, it will be understood that one or more surfactants from one or more compatible classes of surfactants may be employed or utilized in a mixed solubilizing surfactant system. For example, a combination of compatible anionic and nonionic surfactants may be employed. Likewise, a combination of compatible couplers may also be used as may a combination of one or more compatible surfactants from different classes of surfactants together with one or more couplers. Thus, one may use a combination of blended surfactants and couplers to achieve the desired minimal solvent solubilization. The compatibility of the various surfactants and of the various couplers with each other and in combination can be readily determined by simple experimentation.

Similarly, but less preferably, a mixture of the sparingly soluble organic solvents may be employed in formulating the compositions of the invention. However, if a mixture of solvents is to be used, each of the solvents should have nearly the same approximate water solubility so that they will solubilize in water at approximately the same point upon addition of the solubilizing additive.

In addition to the organic solvent and solubilizing additive components of the compositions of the invention, various optional adjuvants can be incorporated. These include chelants such as the sodium salts of ethylenediaminetetraacetic acid (Hampene 100 or Versene 100), thickeners such as carboxy acrylic polymers (Carbopol 940) or acrylic acid/alkyl methacrylate copolymers (Acrysol ICS-1), fragrances, dyes, pH adjustants, defoaming agents, anti-corrosion additives and anti-rust additives. To Prevent flash rusting when the compositions are used to clean and/or degrease metal surfaces, an anti flash-rusting additive such as an alkanolamine (e.g., mono-, di- or triethanolamine) may be incorporated.

In formulating the compositions of the invention, the various components as brought together may first form an oily suspension which becomes an emulsion upon the addition of a surfactant/coupler, and is then finally transformed into a microemulsion through the addition of the final portion of the solubilizing coupler. For example, 2.0 wt. % sodium metasilicate, 7.5 wt. % 1-phenoxy-2-Propanol, 2.5 wt. % tripropyleneglycol monomethyl ether and 76.4 wt. % soft water are stirred to form an oily suspension having a pH of 13.3. 2.4 wt. % dodecylbenzenesulfonic acid is added with stirring to form a creamy white emulsion having a pH of 13.1. 7.2 wt. % sodium xylene sulfonate (40%) is then added with stirring whereupon some slight lightening of the emulsion occurs. The addition of 1.8 wt. % sodium xylene sulfonate (40%) causes the emulsion to become still lighter but it remains opaque. Upon the final addition of 0.2 wt. % sodium xylene sulfonate (40%) with stirring, the white emulsion is transformed into a bluish microcolloidal microemulsion having a pH of 13.05. The microemulsions of the invention can also be formulated by combining the various components together in different sequence to transform any emulsion formed into a microemulsion. The addition of an excess of the solubilizing additive to the formulation will cause the microemulsion to be converted into a solution and is to be avoided if optimum cleaning/degreasing efficacy of the builder-containing formulations is to be achieved.

The concentration of the aqueous cleaner/degreaser solution, as indicated by the terms "total solids content" and "total actives content" in the working examples provided hereinafter refers, respectively, to the combined percentages of nonvolatile components and to the sum total of nonaqueous volatile and nonvolatile components.

The term "cloud point" indicates the temperature below which the composition exists as a clear, single phase microemulsion and above which phase separation (heterogeneity) occurs. For practical reasons, a composition should preferably have a cloud point in excess of, for example 50° C., to have a viably safe, storage-stable shelf life under hot, summertime warehouse conditions.

As shown by the experimental degreasing test data presented below, the compositions of the invention provide enhanced cleaning/degreasing efficacy over that achievable with compositions containing no builder or with available builder-containing compositions formulated in the form of total solutions.

The following examples illustrate the practice of the invention.

EXAMPLE 1

In the following examples of illustrative cleaner/degreaser compositions of the present invention, the compositions were subjected as indicated to the definitive, semiquantitative degreasing test method described below in order to measure their cleaning/degreasing efficacy.

A magnetic stirrer (Fisher Scientific Co., Catalog No. 14-511-1A) provided with a vaned disc magnetic stir bar ($\frac{7}{8}$" (diameter)×$\frac{5}{8}$" (height), 22 mm×15 mm, Fisher Scientific Co., Catalog No. 14-511-98C) was used. In each instance, pre-cleaned, borosilicate glass microslides (3"× 1", 1.0 mm thickness) were thinly smeared/-rub-on coated with Vaseline brand white petroleum jelly on one side only to a distance of 1.0" from the bottom edge to provide a 1.0"×1.0" coated area. The test cleaner/degreaser solutions were employed at full strength unless otherwise indicated and in an amount sufficient to fill a 50 ml Pyrex beaker containing the vaned disc magnetic stirrer bar to a level of 40 ml. Each test solution and surrounding air were maintained at 21°±0.5° C. and the test solution stirring rate was determined by a setting of "3" on the stirrer dial of the magnetic stirrer. The stirring disc was positioned off-center to accommodate each microslide, touching neither the beaker walls nor the microslide and rotating freely when in use. The microslide, in each test, rested upright on the beaker bottom, was allowed to lean against the lip of the beaker at an approximately 75° angle and was positioned with the Vaseline coated face or area facing upward away from the vaned disc magnetic stirrer bar.

For each test, the beaker containing the stirrer bar was filled to 40 ml. with the test cleaning/degreasing solution at the indicated concentration, placed atop the magnetic stirrer plate, and positioned off-center to accommodate the glass microslide, and yet allow the vaned disc stirrer bar to rotate or spin freely. The stirrer was turned on, the dial adjusted manually to the "3" stirring rate setting and the Vaseline thin film coated glass microslide was introduced into the test solution bath in such a manner that the coated side faced upward and was positioned away from the stirrer bar. The time "0" was noted immediately on a watch or clock with a sweep second hand.

At appropriate time intervals, the glass microslide was briefly removed from the cleaner/degreaser solution bath and immediately "read" for "% vaseline removed from the 1.0"×1.0" treated area", an objective determination, after which the microslide was immediately returned to the stirred aqueous cleaner/degreaser bath. The duration of the degreasing test is determined by the time needed for complete, 100% removal of the Vaseline film from the glass microslide surface The accuracy of the above-described test method is of the order of ±5% as determined by replicate run averaging.

EXAMPLE 2

An aqueous, cleaner/degreaser formulation in the form of a microemulsion was prepared having the following composition:

| Component | Wt. % |
|---|---|
| 1-Phenoxy-2-propanol (Dowanol PPh) | 3.0 |
| Monoethanolamine | 1.8 |
| Sodium metasilicate | 1.5 |
| Dodecylbenzenesulfonic acid | 1.0 |
| Soft $H_2O$ | 92.7 |
| | 100.0 |

The sodium metasilicate was dissolved in water with stirring. The monoethanolamine, 1-phenoxy-2-propanol and dodecylbenzenesulfonic acid were added and stirring of the resultant emulsion/suspension was continued until the emulsion gradually cleared to produce an irridescent (blue) microemulsion. The microemulsion had a pH of 12.65, a total solids content of 2.5% and a total actives content of 7.3%. Upon heating, the microemulsion remained irridescent to 50° C., then developed more turbidity up to 75° C. and became a clear, colorless aqueous solution above about 75° C. It exhibited no cloud point to 100° C.

The composition readily removed the following soilant markings from alkyd enameled metal surfaces: black Magic Marker, black and blue indelible ballpoint pen, #1 hardness pencil, red (waxy) crayon, and automotive grease smearings. Some trace smudge was left on the surface. The composition readily removed four coats of floor finish (trade designation "Buckeye Citation" by The Davies-Young Company) from vinyl tile upon 5 minutes contact time at room temperature, followed by swabbing action, a water rinse and air drying.

This composition was subjected to the degreasing test method of Example 1 with the following results:

1st attack on greased slide at 2–3 sec.
30% removal of grease at 30 sec.
60–65% removal of grease at 1.0 min.
100% removal of grease at 1.5 min.

EXAMPLE 3

Example 2 was repeated in formulating an aqueous cleaner/degreaser microemulsion having the following composition:

| Component | Wt. % |
|---|---|
| 1-Phenoxy-2-propanol (Dowanol PPh) | 3.5 |
| Monoethanolamine | 0.5 |
| Sodium Metasilicate | 1.2 |
| Dodecylbenzenesulfonic acid | 1.2 |
| Sodium xylene sulfonate (40%) | 5.0 |
| Soft $H_2O$ | 88.6 |
| | 100.0 |

The composition was a bluish, irridescent microemulsion having a pH of 12.5, a total solids content of 4.4% and a total actives content of 8.4%. Upon heating, the composition remained an irridescent microemulsion to 48° C., became a turbid emulsion between 48°–59° C. and a clear, colorless solution above about 60° C.

The composition effected 100% removal of the markings set forth in Example 2 and also effected 100% removal of four coats of "Buckeye Citation" floor finish as in Example 2.

This composition was subjected to the degreasing test method of Example 1 with the following results:

1st attack on greased slide at 2 sec.
33% removal of grease at 15 sec.
60% removal of grease at 30 sec. 80–85% removal of grease at 45 sec. 100% removal of grease at 1.0 min.

EXAMPLE 4

Example 2 was repeated in formulating an aqueous, cleaner/degreaser microemulsion having the following composition:

| Component | Wt. % |
|---|---|
| 1-Phenoxy-2-propanol (Dowanol PPh) | 3.5 |
| Monoethanolamine | 0.5 |
| Sodium metasilicate | 1.2 |
| Dodecylbenzenesulfonic acid | 1.2 |
| Sodium cumene sulfonate (45%) | 3.5 |
| Soft $H_2O$ | 90.1 |
| | 100.0 |

The composition was a bluish, irridescent microemulsion having a pH of 12.6, a total solids content of 3.98% and a total actives content of 7.98. Upon heating, the composition remained an irridescent microemulsion to 39° C. and became a clear, colorless solution above about 39° C. It exhibited no cloud point to 100° C.

The composition effected 100% removal of the markings set forth in Example 2 with no smudging, and also effected 100% removal of four coats of "Buckwye Citation" floor finish as in Example 2.

This composition was subjected to the degreasing test method of Example 1 with the following results:

10% removal of grease at 15 sec.
25% removal of grease at 30 sec.
45–50% removal of grease at 1.0 min.
70% removal of grease at 1.5 min.

85–90% removal of grease at 2.0 min.
100% removal of grease at 2.5 min.

EXAMPLE 5

Example 2 was repeated in formulating an aqueous, cleaner/degreaser microemulsion having the following composition:

| Component | Wt. % |
|---|---|
| 1-Phenoxy-2-propanol (Dowanol PPh) | 3.5 |
| Monoethanolamine | 0.5 |
| Sodium metasilicate | 1.2 |
| Dodecylbenzenesulfonic acid | 1.2 |
| Sodium Capryloamphopropionate, 50% Monateric CY—Na-50 | 2.0 |
| Soft $H_2O$ | 91.6 |
| | 100.00 |

The composition was a pale yellow, irridescent microemulsion having a pH of 12.5, a total solids content of 3.4% and a total actives content of 7.4%. Upon heating, the composition remained an irridescent microemulsion to 50° C. and became a clear solution at temperatures above 50° C. It exhibited no cloud point.

The composition effected 100% removal of the markings set forth in Example 2 with no to very slight smudging, and also effected 95–100% removal of four coats of "Buckeye Citation" floor finish as in Example 2.

This composition was subjected to the degreasing test method of Example 1 with the following results 1st attack on greased slide at 3 sec.
20–25% removal of grease at 15 sec.
50% removal of grease at 30 sec.
85–90% removal of grease at 45 sec. 100% removal of grease at 1.0 min.

EXAMPLE 6

Example 2 was repeated in formulating an aqueous, cleaner/degreaser microemulsion having the following composition:

| Component | Wt. % |
|---|---|
| 1-Phenoxy-2-propanol (Dowanol PPh) | 4.0 |
| Sodium metasilicate | 1.0 |
| Sodium hydroxide (50%) | 0.2 |
| Dodecylbenzenesulfonic acid | 1.5 |
| Sodium xylene sulfonate (40%) | 5.0 |
| Monoethanolamine | 0.5 |
| Soft $H_2O$ | 87.8 |
| | 100.00 |

The composition was a bluish, irridescent microemulsion having a pH of 12.65, a total solids content of 4.6% and a total actives content of 9.1%. Upon heating, the composition remained an irridescent microemulsion to 51.5° C., was turbid in the range 50°–60° C., and was a clear, colorless solution above about 60° C.

The composition effected 100% removal of the markings set forth in Example 2 with slight smudging and also effected 100% removal of four coats of "Buckeye Citation" floor finish as in Example 2.

The composition was subjected to the degreasing test method of Example 1 with the following results:

20% removal of grease at 30 sec.
35% removal of grease at 1.0 min.
60% removal of grease at 2.0 min.
90% removal of grease at 3.0 min.
100% removal of grease at 3.33 min.

EXAMPLE 7

A control composition was prepared by combining the following components in the amounts indicated:

| Component | Wt. % |
|---|---|
| 1-Phenoxy-1-propanol (Dowanol PPh) | 4.0 |
| Dodecylbenzenesulfonic acid | 1.7 |
| Sodium hydroxide (50%) | 0.5 |
| Monoethanolamine | 1.5 |
| Soft $H_2O$ | 92.3 |
| | 100.0 |

The composition was a clear, essentially colorless solution containing no builder component. It had a pH of 11.7, a total solids content of 1.844% and a total actives content of 7.344%. It exhibited no cloud point to 100° C.

The composition quite easily removed the following percentages of the markings set forth in Example 2 from alkyd enameled metal surfaces: 85–90% removal of black Magic Marker felt pen 80% removal of black indelible ballpoint pen
100% removal of blue indelible ballpoint pen
90% removal of #1 pencil
95% removal of red (waxy) crayon
100% removal of automobile grease smearings There was slight smudging with the black Magic Marker and black indelible ballpoint pen markings. The composition also effected 100% removal of four coats of "Buckeye Citation" floor finish as in Example 2.

The composition was subjected to the degreasing test method of Example 1 with the following results:

10–15% removal of grease at 15 sec.
25% removal of grease at 30 sec.
45% removal of grease at 1.0 min.
70–75% removal of grease at 2.0 min.
90% removal of grease at 3.0 min.
100% removal of grease at 3.5 min.

EXAMPLE 8

An aqueous, cleaner/degreaser formulation in the form of a microemulsion was prepared having the following composition:

| Component | Wt. % |
|---|---|
| 1-Phenoxy-2-propanol (Dowanol PPh) | 4.0 |
| Dodecylbenzenesulfonic acid | 1.7 |
| Sodium hydroxide (50%) | 0.4 |
| Monoethanolamine | 0.9 |
| Soft $H_2O$ | 92.6 |
| Sodium metasilicate | 0.4 |
| | 100.0 |

All of the above components except the sodium metasilicate were stirred together to form an aqueous solution. The sodium metasilicate was then added as granules and upon dissolving in the solution, a microemulsion was formed having a bluish, irridescent appearance. The microemulsion had a pH of 12.1, a total solids content of 2.22% and a total actives content of 7.12%. Upon heating, the microemulsion remained irridescent to 37° C.

and became a clear, colorless solution above about 37° C. It exhibited no cloud point.

The composition effected 100% removal of the markings set forth in Example 2 with no smudging and also effected 100% removal of four coats of "Buckeye Citation" floor finish as in Example 2.

This composition was subjected to the degreasing test method of Example 1 with the following results 33% removal of grease at 15 sec.
60% removal of grease at 30 sec.
85-90% removal of grease at 45 sec.
100% removal of grease at 1.0 min.

EXAMPLE 9

An aqueous, cleaner/degreaser formulation in the form of a microemulsion was prepared having the following composition:

| Component | Wt. % |
|---|---|
| 1-Phenoxy-2-propanol (Dowanol PPh) | 4.0 |
| Dodecylbenzenesulfonic acid | 1.7 |
| Sodium Hydroxide (50%) | 0.5 |
| Monoethanolamine | 1.5 |
| Soft $H_2O$ | 91.9 |
| Sodium metasilicate | 0.4 |
| | 100.0 |

All of the above components except the sodium metasilicate were stirred together to form a clear, aqueous solution. The sodium metasilicate was then added as granules and upon dissolving in the solution, a microemulsion was formed having a bluish, irridescent appearance. The microemulsion had a pH of 12.3, a total solids content of 2.24% and a total actives content of 7.74%. Upon heating, the microemulsion remained irridescent to 41° C. Above about 41° C. it became a clear, colorless solution. It exhibited no cloud point.

The composition effected 100% removal of the markings set forth in Example 2 with very slight tendency to smudge and also effected 100% removal of four coats of "Buckeye Citation" floor finish as in Example 2.

This composition was subjected to the degreasing test method of Example 1 with the following results 25-30% removal of grease at 15 sec.
60-65% removal of grease at 30 sec.
85-90% removal of grease at 45 sec.
100% removal of grease at 50 sec.

By comparison with the results set forth in Example 7, the above results show the enhanced degreasing activity achieved through the incorporation of a builder.

EXAMPLE 10

Examples 8 and 9 were repeated in preparing a microemulsion cleaner/degreaser formulation having the following composition:

| Component | Wt. % |
|---|---|
| 1-Phenoxy-2-propanol (Dowanol PPh) | 4.0 |
| Dodecylbenzenesulfonic acid | 1.6 |
| Sodium hydroxide (50%) | 0.4 |
| Monoethanolamine | 1.5 |
| Soft $H_2O$ | 92.1 |
| Sodium metasilicate | 0.4 |
| | 100.0 |

The microemulsion had a bluish, irridescent appearance, a pH of 12.3, a total solids content of 2.12% and a total actives content of 7.62%. Upon heating, the microemulsion remained irridescent to 44° C. and above which it formed a clear, colorless solution. It exhibited no cloud point.

The composition effected 100% removal of all markings including auto grease as set forth in Example 2 and also effected 100% removal of four coats of "Buckeye Citation" floor finish as in Example 2.

The composition was subjected to the degreasing test method of Example with the following results:

1st attack on greased slide at 1-2 sec.
40% removal of grease at 15 sec.
70-75% removal of grease at 30 sec.
100% removal of grease at 45 sec.

EXAMPLE 11

Examples 8 and 9 were repeated in preparing a microemulsion cleaner/degreaser formulation having the following composition:

| Component | Wt. % |
|---|---|
| 1-Phenoxy-2-propanol (Dowanol PPh) | 4.0 |
| Dodecylbenzenesulfonic acid | 1.6 |
| Sodium hydroxide (50%) | 0.4 |
| Monoethanolamine | 1.5 |
| Soft $H_2O$ | 92.0 |
| Sodium metasilicate | 0.5 |
| | 100.0 |

The microemulsion had a bluish, irridescent appearance, a pH of 12.4, a total solids contents of 2.22% and a total actives content of 7.72%. Upon heating, the microemulsion remained irridescent to 52.5° C. and became a clear solution above 52.5° C. It exhibited no cloud point.

The composition effected 100% removal of all markings set forth in Example 2 with no smudging and also effected 100% removal of four coats of "Buckeye Citation" floor finish as in Example 2.

This composition was subjected to the degreasing test method of Example 1 with the following results:

20-25% removal of grease at 15 sec.
50% removal of grease at 30 sec.
75% removal of grease at 1.0 min.
85-90% removal of grease at 1.5 min. 100% removal of grease at 2.0 min.

EXAMPLE 12

An aqueous, cleaner/degreaser formulation in the form of a microemulsion was prepared having the following composition:

| Component | Wt. % |
|---|---|
| 1-Phenoxy-2-propanol (Dowanol PPh) | 4.0 |
| Dodecylbenzenesulfonic acid | 1.5 |
| Sodium hydroxide (50%) | 0.4 |
| Soft $H_2O$ | 93.7 |
| Tetrapotassium pyrophosphate | 0.4 |
| | 100.0 |

All of the above components except tetrapotassium pyrophosphate were stirred together and the pH adjusted to 7.0 with a trace of sodium sesquicarbonate to obtain a clear, colorless aqueous solution. The tetrapotassium pyrophosphate was then added as granules and the solution immediately changed to a bluish, irridescent microemulsion. The microemulsion had a pH of 9.11, a total solids content of 2.11% and a total actives content of 6.115%. Upon heating, the microemulsion remained irridescent to 42° C. It exhibited no cloud point to 100° C. and no flash point.

The composition effected 100%, easy and fast removal of all markings set forth in Example 2.

This composition was subjected to the degreasing test method of Example 1 with the following results:

1st attack on greased slide at 2 sec.
45% removal of grease at 15 sec.
90-95% removal of grease at 30 sec.
100% removal of grease at 35 sec.

EXAMPLE 13

Example 12 was repeated in preparing a microemulsion cleaner/degreaser formulation having following composition:

| Component | Wt. % |
|---|---|
| 1-Phenoxy-2-propanol | 4.0 |
| Dodecylbenzenesulfonic acid | 1.5 |
| Sodium hydroxide (50%) | 0.4 |
| Soft $H_2O$ | 93.7 |
| Borax | 0.4 |
| | 100.0 |

The microemulsion formed upon the addition of borax granules to the other components and the slow dissolution of the borax produced a gradual change from a clear, aqueous solution to a bluish, irridescent microemulsion. The microemulsion had a pH of 8.93, a total solids content of 2.115% and a total actives content of 6.115%. Upon heating, the microemulsion remained irridescent to 38° C., clearing at 38.5° C and becoming a clear, colorless solution above about 39° C. It exhibited no cloud point to 100° C. and no flash point.

The composition effected 100% facile removal of all markings set forth in Example 2.

This composition was subjected to the degreasing test method of Example 1 with the following results:

1st attack on greased slide at 1-2 sec.
50-55% removal of grease at 15 sec.
80% removal of grease at 30 sec.
100% removal of grease at 40 sec.

EXAMPLE 14

Example 12 was repeated in preparing a microemulsion cleaner/degreaser formulation having the following composition:

| Component | Wt. % |
|---|---|
| 1-Phenoxy-2-propanol (Dowanol PPh) | 4.0 |
| Dodecylbenzenesulfonic acid | 1.5 |
| Sodium hydroxide (50%) | 0.4 |
| Soft $H_2O$ | 93.6 |
| Sodium carbonate | 0.5 |
| | 100.0 |

The addition of the sodium carbonate in powder form to a clear, colorless aqueous solution of the other components produced the instantaneous development of a bluish, irridescent microemulsion. The microemulsion had a pH of 10.75, a total solids content of 2.215% and a total actives content of 6.215%. The microemulsion, unlike those of Examples 12and 13, was slightly viscous and had a Brookfield viscosity of 37 cps. at 21° C. Upon heating, the microemulsion remained irridescent to 60.5° C. and became a clear, colorless aqueous solution above about 61° C. It exhibited no cloud point to 100° C.

The composition effected 100%, fast removal of all markings set forth in Example 2.

This composition was subjected to the degreasing test method of Example 1 with the following result:

1st attack in greased slide at 2 sec.
30-35% removal of grease at 15 sec.
60% removal of grease at 30 sec.
85-90% removal of grease at 40 sec.
100% removal of grease at 50 sec.

EXAMPLE 15

Example 2 was repeated in formulating an aqueous, cleaner/degreaser microemulsion having the following composition:

| Component | Wt. % |
|---|---|
| 2-Phenoxyethanol (Dowanol EPh) | 6.4 |
| Dodecylbenzenesulfonic acid | 2.5 |
| Anhydrous sodium metasilicate | 3.5 |
| Chelating agent (Hampene 100, 40%) | 2.0 |
| Sodium xylene sulfonate (40%) | 7.5 |
| Soft $H_2O$ | 78.1 |
| | 100.0 |

The composition was a faint bluish, microemulsion having a pH of 12.86, a total solids content of 9.8% and a total actives content of 16.2%. It exhibited no cloud content of point to 100° C. and no flash point.

At a 1:5 dilution with water, the composition effected 75% removal of black Magic Marker markings from an alkyd enameled steel panel.

This composition at a 1:2 dilution with water was subjected to the degreasing test method of Example 1 with the following results:

1st attack on greased slide at 8 sec.
10% removal of grease at 30 sec.
30% removal of grease at 1.0 min.
55% removal of grease at 2.0 min.
80-85% removal of grease at 4.0 min.
100% removal of grease at 6.0 min.

EXAMPLE 16

Example 2 was repeated in formulating an aqueous, cleaner/degreaser microemulsion having the following composition:

| Component | Wt. % |
|---|---|
| Anhydrous sodium metasilicate | 3.6 |
| Dodecylbenzenesulfonic acid | 2.80 |
| Chelating Agent (Hampene 100) | 2.00 |
| Propyleneglycol monomethyl ether | 2.00 |
| Dipropyleneglycol monomethyl ether | 0.95 |
| Tripropyleneglycol monomethyl ether | 0.70 |

-continued

| Component | Wt. % |
|---|---|
| 1-Phenoxy-2-propanol (Dowanol PPh) | 6.35 |
| Sodium xylene sulfonate | 8.50 |
| Soft $H_2O$ | 73.10 |
| | 100.0 |

The composition was a faint, bluish, colloidal microemulsion having a pH of 13.23, a total solids content of 10.6% and a total actives content of 20.6%. It exhibited no cloud point and no flash point.

At a 1:5 dilution with water, the composition effected 90% removal of black Magic Marker markings from an alkyd enameled steel panel.

This composition at a 1:2 dilution with water was subjected to the degreasing test method of Example 1 with the following results:

1st attack on greased slide at 5 sec.
15% removal of grease at 30 sec.
35% removal of grease at 1.0 min.
70% removal of grease at 2.0 min.
90% removal of grease at 3.0 min.
100% removal of grease at 3.75 min.

EXAMPLE 17

Example 2 was repeated in formulating an aqueous having the following composition:

| Component | Wt. % |
|---|---|
| Anhydrous sodium metasilicate | 5.50 |
| Dodecylbenzenesulfonic acid | 5.00 |
| Chelating Agent (Hampene 100) | 2.00 |
| Propyleneglycol monomethyl ether | 2.00 |
| Dipropyleneglycol monomethyl ether | 0.95 |
| Tripropyleneglycol monomethyl ether | 0.70 |
| 1-Phenoxy-2-propanol (Dowanol PPh) | 6.35 |
| Sodium xylene sulfonate (40%) | 8.5 |
| Soft $H_2O$ | 69.0 |
| | 100.0 |

The components formed a clear, aqueous solution rather than a microemulsion because the composition included an excess of solubilizing additive over that required to form a microemulsion.

At a 1:5 dilution with water, the solution effected 0% removal of black Magic Marker markings from an alkyd enameled steel panel.

The solution at a 1:2 dilution with water was subjected to the degreasing test method of Example 1 with the following results:

1st attack on greased slide at 2.5 min.
10% removal of grease at 4.5 min.
20–25% removal of grease at 10 min.
50% removal of grease at 20 min.
70% removal of grease at 30 min.
90–95% removal of grease at 50 min.
100% removal of grease at 65 min.

EXAMPLE 18

Example 2 was repeated in formulating an aqueous microemulsion having the following composition:

| Component | Wt. % |
|---|---|
| Anhydrous sodium metasilicate | 4.0 |
| Dodecylbenzenesulfonic acid | 2.0 |
| Propylene glycol mono-t-butyl ether (Arcosolve PTB) | 9.5 |
| Chelating agent (Hampene 100) | 3.0 |
| Soft $H_2O$ | 81.5 |
| | 100.0 |

The organic solvent component, Propylene glycol mono-t-butyl ether, has an aqueous solubility of 13.9 wt. % at 21° C. The composition was a very faint bluish, colloidal microemulsion having a pH of 13.73, a total solids content of 7.2% and a total actives content of 16.7%. It had a cloud point of 28° C.

At a 1:5 dilution with water, the composition effected 60% removal of black Magic Marker markings from an alkyd enameled steel surface.

This composition at a 1:2 dilution with water became solution and was subjected to the degreasing test method of Example 1 with the following results:

1st attack on greased slide at 7 sec.
20–25% removal of grease at 1.0 min.
33% removal of grease at 2.0 min.
40% removal of grease at 3.0 min.
45–50% removal of grease at 4.0 min.
60% removal of grease at 5.0 min.
54–70% removal of grease at 6.0 min.
75% removal of grease at 7.0 min.
80% removal of grease at 8.0 min.
85% removal of grease at 9.0 min.
90% removal of grease at 10.0 min.
95% removal of grease at 12.0 min.
100% removal of grease at 13.5 min.

EXAMPLE 19

Example 2 was repeated in formulating an aqueous, cleaner/degreaser microemulsion having the following composition:

| Component | Wt. % |
|---|---|
| Anhydrous sodium metasilicate | 2.0 |
| Nonylphenol ethoxylate (T-Det N-14) | 3.5 |
| Chelating agent (Hampene 100, 40%) | 2.0 |
| Dipropylenegycol monomethyl ether | 3.5 |
| 1-Phenoxy-2-propanol (Dowanol PPh) | 6.5 |
| Sodium xylene sulfonate (40%) | 11.0 |
| Soft $H_2O$ | 71.5 |
| | 100.0 |

The composition was a slightly bluish, colloidal microemulsion having a pH 13.62, a total solids content of 10.7% and a total actives content of 20.7%. It had a cloud point of 26° C. and no flash point.

At a 1:5 dilution with water, the composition effected 100% removal of black Magic Marker Markings from an alkyd enameled steel panel.

This composition at a 1:2 dilution with water was subjected to the degreasing test method of Example 1 with the following results:

1st attack on greased slide at 5 sec.
25% removal of grease at 20 sec.

60% removal of grease at 40 sec.
85-90% removal of grease at 1.0 min.
100% removal of grease at 1.5 min.

EXAMPLE 20

Example 2 was repeated in formulating an aqueous, cleaner/degreaser microemulsion having the following composition:

| Component | Wt. % |
|---|---|
| Anhydrous sodium metasilicate | 2.0 |
| Dodecylbenzenesulfonic acid | 1.5 |
| Chelating agent (Hampene 100, 40%) | 5.0 |
| Benzyl acohol | 9.0 |
| Tripropyleneglycol monomethyl ether | 1.0 |
| Sodium xylene sulfonate (40%) | 9.5 |
| Soft $H_2O$ | 7.2 |
| | 100.0 |

The composition was faint bluish microemulsion having a pH of 13.19, a total solids content of 9.3% and a total actives content of 19.3%. It had a cloud point in excess of 100° C. and no flash point.

At a 1:5 dilution with water, the composition effected 50% removal of black Magic Marker markings from an alkyd enameled steel panel.

This composition at a 1:2 dilution with water was subjected to the degreasing test method of Example 1 with the following results:

1st attack on greased slide at 4 sec.
35% removal of grease at 30 sec.
60% removal of grease at 1.0 min.
75-80% removal of grease at 1.5 min.
85-90% removal of grease at 2.0 min.
95% removal of grease at 2.5 min.
100% removal of grease at 2.75 min.

EXAMPLE 21

Example 2 was repeated in formulating an aqueous, cleaner/degreaser microemulsion having the following composition:

| Component | Wt. % |
|---|---|
| Anhydrous sodium metasilicate | 2.0 |
| Dodecylbenzenesulfonic acid | 2.5 |
| Chelating agent (Hampene 100, 40%) | 1.5 |
| Tripropyleneglycol monomethyl ether | 2.5 |
| 1-Phenoxy-2-propanol (Dowanol PPh) | 7.0 |
| Sodium xylene sulfonate (40%) | 9.0 |
| Soft $H_2O$ | 75.5 |
| | 100.0 |

The composition was a faint bluish microemulsion having a pH of 13.05 a total solids content of 8.7% and a total actives content of 18.2%. It had a cloud point of approximately 75° C. and no flash point.

At a 1:5 dilution with water, the composition effected approximately 95% of black Magic Marker markings from an alkyd enameled steel panel.

This composition at a 1:2 dilution with water was subjected to the degreasing test method of Example 1 with the following results:

1st attack on greased slide at 4 sec.
45% removal of grease at 30 sec.
65-70% removal of grease at 1.0 min.
80% removal of grease at 1.5 min.
90% removal of grease at 2.0 min.
100% removal of grease at 2.5 min.

EXAMPLE 22

Example 21 was repeated in formulating an aqueous microemulsion containing no builder component and having the following composition:

| Component | Wt. % |
|---|---|
| Dodecylbenzenesulfonic acid | 2.5 |
| Sodium hydroxide (50%) | 0.4 |
| Chelating agent (Hampene 100, 40%) | 1.5 |
| Tripropyleneglycol monomethyl ether | 2.5 |
| 1-Phenoxy-2-propanol (Dowanol PPh) | 7.0 |
| Sodium xylene sulfonate (40%) | 6.5 |
| Soft $H_2O$ | 7.96 |
| | 100.0 |

The small amount of sodium hydroxide was included to partially neutralize the dodecylbenzenesulfonic acid and cause salt formation. The composition was a faint opalescent microemulsion having a pH of 7.0, a total solids content of 5.9% and a total actives content of 15.4%. It had a cloud point in excess of 100° C. and exhibited no flash point.

At a 1:5 dilution with water, the composition effected only 0-5% removal of black Magic Marker markings from an alkyd enameled steel panel.

The composition at a 1:2 dilution with water was subjected to the degreasing test method of Example 1 with the following results:

1st attack on greased slide at 11 sec.
5-10% removal of grease at 30 sec.
30% removal of grease at 1.0 min.
55-60% removal of grease at 1.5 min.
70% removal of grease at 2.0 min.
85-90% removal of grease at 3.0 min
95% removal of grease at 4.0 min.
100% removal of grease at 4.5 min.

Thus, by comparison with the composition of Example 21, the composition of this example containing no builder component was less effective than the builder-containing composition of Example 21.

EXAMPLE 23

Example 2 was repeated in formulating an aqueous, cleaner/degreaser microemulsion having the following composition:

| Component | Wt. % |
|---|---|
| Sodium tripolyphosphate | 2.0 |
| Dodecylbenzenesulfonic acid | 2.5 |
| Chelating agent (Hampene 100, 40%) | 1.5 |
| Tripropyleneglycol monomethyl ether | 2.5 |
| 1-Phenoxy-2-propanol (Dowanol PPh) | 7.0 |
| Sodium xylene sulfonate (40%) | 7.5 |
| Soft $H_2O$ | 76.4 |
| | 100.0 |

The composition was a bluish, opalescent microemulsion having a pH of 11.27, a total solids content of 8.4% and a total actives content of 17.9%. It had a cloud point in excess of 100° C. and exhibited no flash point.

At a 1:5 dilution with water, the composition effected 60% removal of black Magic Marker markings from an alkyd enameled steel panel.

The composition at a 1:2 dilution with water was subjected to the degreasing test method of Example 1 with the following results:

1st attack on greased slide at 6 sec.
25% removal of grease at 30 sec.
40–45% removal of grease at 1.0 min.
65–70% removal of grease at 1.5 min.
80% removal of grease at 2.0 min.
90% removal of grease at 2.5 min.
100% removal of grease at 3.0 min.

EXAMPLE 24

Example 2 was repeated in formulating an aqueous, cleaner/degreaser microemulsion having the following composition:

| Component | Wt. % |
|---|---|
| Anhydrous sodium metasilicate | 2.2 |
| Dodecylbenzenesulfonic acid | 2.5 |
| Polyglycol 112-2 (Dow) Block ethylene oxide/ propylene oxide copolyol, terminated by glycerol) | 10.0 |
| Soft $H_2O$ | 85.3 |
| | 100.0 |

The composition was a very faint microemulsion having a pH of 12.73, and a total solids and total actives content of 14.7%. It had a cloud point of 40° C. and exhibited no flash point.

At a 1:5 dilution with water, the composition effected 100% removal of black Magic Marker markings from an alkyd enameled steel panel.

The composition at a 1:2 dilution with water was subjected to the degreasing test method of Example 1 with the following results:

1st attack on greased slide at 4 sec.
20% removal of grease at 30 sec.
55–60% removal of grease at 1.0 min.
80% removal of grease at 1.5 min.
100% removal of grease at 2.0 min.

EXAMPLE 25

Example 2 was repeated in preparing the following composition containing a highly water soluble organic solvent instead of a sparingly water soluble organic solvent:

| Component | Wt. % |
|---|---|
| Anhydrous sodium metasilicate | 2.0 |
| Dodecylbenzenesulfonic acid | 2.4 |
| Ethylene glycol monobutyl ether (Butyl Cellosolve) | 10.0 |
| Soft $H_2O$ | 85.6 |
| | 100.0 |

The composition was a clear, very pale yellow solution having a pH of 12.53, a total solids content of 4.4% and a total actives content of 14.4%. It had a cloud point in excess of 100° C.

At a 1:5 dilution with water, the composition effected less than 5% removal of black Magic Marker markings from an alkyd enameled steel panel.

The composition at a 1:2 dilution with water was subjected to the degreasing test method of Example 1 with the following results:

1st attack on greased slide at 20 sec.
15% removal of grease at 1.0 min.
25–30% removal of grease at 20 min.
35–40% removal of grease at 3.0 min.
45% removal of grease at 4.0 min.
50–55% removal of grease at 6.0 min.
65% removal of grease at 10.0 min.
75% removal of grease at 15.0 min.
80% removal of grease at 20.0 min.
85% removal of grease at 25.0 min.
90% removal of grease at 30.0 min.
95% removal of grease at 35.0 min.
100% removal of grease at 39.0 min.

EXAMPLE 26

Example 2 was repeated in formulating an aqueous, cleaner/degreaser microemulsion having the following composition:

| Component | Wt. % |
|---|---|
| Anhydrous sodium metasilicate | 2.3 |
| Dodecylbenzenesulfonic acid | 2.8 |
| Tripropyleneglycol monomethyl ether | 5.0 |
| Acetophenone | 5.0 |
| Soft $H_2O$ | 84.9 |
| | 100.0 |

The composition was a bluish, irridescent microemulsion having a pH of 12.61, a total solids content of 5.1% and a total actives content of 15.1%. It had a cloud point in excess of 100° C. and exhibited no flash point.

At a 1:5 dilution with water, the composition effected 100% removal of black Magic Marker markings from an alkyd enameled steel panel.

The composition at a 1:2 dilution with water was subjected to the degreasing test method of Example 1 with the following results:

1st attack on greased slide at 5 sec.
25–30% removal of grease at 30 sec.
70% removal of grease at 1.0 min.
100% removal of grease at 1.5 min.

EXAMPLE 27

Example 2 was repeated in formulating an aqueous cleaner/degreaser microemulsion having the following composition:

| Component | Wt. % |
|---|---|
| Anhydrous sodium metasilicate | 2.0 |
| Dodecylbenzenesulfonic acid | 2.5 |
| Cyclohexanol | 8.5 |
| Tripropyleneglycol monomethyl ether | 1.5 |
| Sodium xylene sulfonate (40%) | 5.4 |
| Soft $H_2O$ | 80.1 |
| | 100.0 |

The composition was a faint bluish microemulsion having a pH of 12.74, a total solids content of 6.66% and a total actives content of 16.66%. It had a cloud point of 65° C.

At a dilution of 1:5 with water, the composition effected approximately 65% removal of black Magic Marker markings from an alkyd enameled steel panel.

The composition at a 1:2 dilution with water was subjected to the degreasing test method of Example 1 with the following results:

1st attack on greased slide at 1.5 sec.
5-10% removal of grease at 30 sec.
15% removal of grease at 1.0 min.
20% removal of grease at 2.0 min.
30% removal of grease at 3.0 min.
40% removal of grease at 4.0 min.
50-55% removal of grease at 5.0 min.
70% removal of grease at 6.0 min.
85% removal of grease at 7.0 min.
100% removal of grease at 8.0 min.

EXAMPLE 28

Example 2 was repeated in formulating an aqueous, cleaner/degreaser microemulsion having the following composition:

| Component | Wt. % |
|---|---|
| Anhydrous sodium metasilicate | 2.0 |
| 2-Phenoxyethanol (Dowanol EPh) | 9.0 |
| Coco betaine (30%) | 4.0 |
| Sodium xylene sulfonate (40%) | 9.6 |
| Soft $H_2O$ | 75.4 |
| | 100.0 |

The composition was a light bluish, irridescent microemulsion having a pH of 13.42, a total solids content of 7.04 and a total actives content of 16.04%. It had a cloud point above 100° C. and no flash point.

At a dilution of 1:5 with water, the composition effected 100% removal of black Magic Marker markings from an alkyd enameled steel panel.

The composition at a 1:2 dilution with water was subjected to the degreasing test method of Example 1 with the following results:

1st attack on greased slide at 3 sec.
25-30% removal of grease at 30 sec.
65-70% removal of grease at 1.0 min.
100% removal of grease at 1.5 min.

EXAMPLE 29

An aqueous, cleaner/degreaser formulation in the form of a microemulsion was prepared having the following composition:

| Component | Wt. % |
|---|---|
| Monoethanolamine | 0.5 |
| Sodium Metasilicate | 2.0 |
| 1-Phenoxy-2-propanol (Dowanol PPh) | 7.0 |
| Tripropyleneglycol monomethyl ether | 3.0 |
| Dodecylbenzenesulfonic acid | 3.0 |
| Soft $H_2O$ | 82.4 |
| Isodecyloxypropylimino-dipropionic acid ("Alkali Surfactant", Tomah Products, 35%) | 2.0 |
| Defoaming agent (Atsurf F-12) | 0.1 |
| | 100.0 |

The sodium metasilicate was dissolved in water with stirring. The monoethanolamine was added followed by the addition of the 1-phenoxy-2-propanol, tripropyleneglycol monomethyl ether and dodecylbenzenesulfonic acid with stirring. Stirring was continued until a homogeneous emulsion formed. The Alkali Surfactant was then added and the emulsion was transformed into a microemulsion after which the defoaming agent was added. The resulting microemulsion had a slightly bluish, irridescent appearance, a pH of 12.42, a total solids content of 5.7% and a total actives content of 16.2%. It exhibited a cloud point in excess of 100° C.

The composition at a 1:2 dilution with water was subjected to the degreasing test method of Example 1 with the following results:

1st attack on greased slide at 1 sec.
40% removal of grease at 15 sec.
75% removal of grease at 30 sec.
100% removal of grease at 65 sec.

In view of the above, it will be seen that the several objects of the invention are achieved and other advantageous results attained.

As various changes could be made in the above compositions without departing from the scope of the invention, it is intended that all matter contained in the above description or shown in the accompanying drawings shall be interpreted as illustrative and not in a limiting sense.

What is claimed is:

1. A stable, aqueous cleaner/degreaser composition in the form of a microemulsion comprising:

(a) at least one sparingly water soluble organic solvent characterized by:
  (i) having a water solubility in the range of approximately 0.2 to approximately 6 weight percent;
  (ii) not being a hydrocarbon or halocarbon;
  (iii) having one or more similar or dissimilar oxygen, nitrogen, sulfur or phosphorous containing functional groups;
  (iv) being a solvent for hydrophobic soilants; and
  (v) being present in an amount exceeding its aqueous solubility;

(b) from approximately 0.25 wt. % to 10.0 wt. % of a builder;

(c) a solubilizing additive consisting of from approximately 0.1 to approximately 100 weight percent of a surfactant and from 0 to approximately 99.9 weight percent of a coupler, said solubilizing additive being present in an amount not substantially exceeding the amount required to transform the combination of said organic solvent and said builder from the form of a true macroemulsion to the form of a microemulsion and less than that required to form a true solution; and (d) water.

2. A stable, aqueous cleaner/degreaser composition as set forth in claim 1 wherein said organic solvent has a water solubility in the range of approximately 1 to approximately 2.5 weight percent.

3. A stable, aqueous cleaner/degreaser composition as set forth in claim 1 wherein said organic solvent is selected from the group consisting of esters, alcohols, ketones, aldehydes, ethers and nitriles.

4. A stable, aqueous cleaner/degreaser composition as set forth in claim 1 wherein said organic solvent is further characterized by having a high flash point in excess of 60° C.

5. A stable, aqueous cleaner/degreaser composition as set forth in claim 1 wherein said organic solvent is further characterized by having a low level of odor.

6. A stable, aqueous cleaner/degreaser composition as set forth in claim 1 wherein said organic solvent is selected from the group consisting of 2-phenoxyethanol, 1-phenoxy-2-propanol, β-phenylethanol, acetophenone, benzyl alcohol, butoxyethyl acetate, isophorone and the dimethyl esters of mixed succinic, glutaric and adipic acids.

7. A stable, aqueous cleaner/degreaser composition as set forth in claim 1 wherein said builder is selected from the group consisting of alkali metal hydroxides, alkali metal silicates and metasilicates, alkali metal carbonates, bicarbonates and sesquicarbonates, borax, alkali metal phosphates, pyrophosphates, tripolyphosphates, hexametaphosphates and tetraphosphates, and alkali metal perborates.

8. A stable, aqueous cleaner/degreaser composition as set forth in claim 1 wherein said builder is sodium metasilicate.

9. A stable, aqueous cleaner/degreaser composition as set forth in claim 1 wherein said builder is sodium carbonate.

10. A stable, aqueous cleaner/degreaser composition as set forth in claim 1 wherein said builder is sodium tripolyphosphate.

11. A stable, aqueous cleaner/degreaser composition as set forth in claim 1 wherein said builder is tetrapotassium pyrophosphate.

12. A stable, aqueous cleaner/degreaser composition as set forth in claim 1 wherein said builder is borax.

13. A stable, aqueous cleaner/degreaser composition as set forth in claim 1 wherein said surfactant is selected from the group consisting of anionic, nonionic, cationic and amphoteric surfactants.

14. A stable, aqueous cleaner/degreaser composition as set forth in claim 1 wherein said surfactant is an anionic surfactant selected from the group consisting of dodecylbenzene sulfonic acid, sodium dodecylbenzenesulfonate, potassium dodecylbenzene sulfonate, triethanolamine dodecylbenzene sulfonate, morpholinium dodecylbenzene sulfonate, ammonium dodecylbenzene sulfonate, isopropylamine dodecylbenzene sulfonate, sodium tridecylbenzene sulfonate, sodium dinonylbenzene sulfonate, potassium didodecylbenzene sulfonate, dodecyl diphenyloxide disulfonic acid, sodium dodecyl diphenyloxide disulfonate, isopropylamine decyl diphenyloxide disulfonate, sodium hexadecyloxypoly(ethyleneoxy)(10)ethyl sulfonate, potassium octylphenoxypoly(ethyleneoxy)(9)ethyl sulfonate, sodium alpha $C_{12-14}$ olefin sulfonate, sodium hexadecane-1 sulfonate, sodium ethyl oleate sulfonate, potassium octadecenylsuccinate, sodium oleate, potassium laurate, triethanolamine myristate, morpholinium tallate, potassium tallate, sodium lauryl sulfate, diethanolamine lauryl sulfate, sodium laureth (3) sulfate, ammonium laureth (2) sulfate, sodium nonylphenoxypoly(ethyleneoxy)(4) sulfate, sodium decyloxypoly(ethyleneoxy (5)methyl)carboxylate, sodium octylphenoxypoly(ethyleneoxy (8)methyl)carboxylate, sodium mono decyloxypoly(ethyleneoxy)(4)phosphate, sodium didecyloxypoly(ethyleneoxy)(6)phosphate, and potassium mono/dioctylphenoxypoly(ethyleneoxy)(9)phosphate.

15. A stable, aqueous cleaner/degreaser composition as set forth in claim 1 wherein said surfactant is a nonionic surfactant selected from the group consisting of octylphenoxypoly(ethyleneoxy)(11)ethanol, nonylphenoxypoly(ethyleneoxy)(13)ethanol, dodecylphenoxypoly(ethyleneoxy)(10)ethanol, polyoxyethylene (12) lauryl alcohol, polyoxyethylene (14) tridecyl alcohol, lauryloxypoly(ethyleneoxy)(10)ethyl methyl ether, undecylthiopoly(ethyleneoxy) (12)ethanol, methoxypoly(oxyethylene(10)/(oxypropylene (20))-2-propanol block copolymer, nonyloxypoly(propyleneoxy) (4)/(ethyleneoxy)(16)ethanol, dodecyl polyglycoside, polyoxyethylene(9)-monolaurate, polyoxyethylene(8-)monoundecanoate, polyoxyethylene(20)sorbitan monostearate, polyoxyethylene(18)sorbitol monotallate, sucrose monolaurate, lauramidopropyl-N,N-dimethylamine oxide, 1:1 lauric diethanolamide, 1:1 coconut diethanolamide, 1:1 mixed fatty acid diethanolamide, polyoxyethylene(6) lauramide, 1:1 soya diethanolamidopoly(ethyleneoxy)(8) ethanol, and coconut diethanolamide.

16. A stable, aqueous cleaner/degreaser composition as set forth in claim 1 wherein said surfactant is a cationic surfactant selected from the group consisting of a mixture of n-alkyl dimethyl ethylbenzyl ammonium chlorides, hexadecyltrimethylammonium methosulfate, didecyldimethylammonium bromide and a mixture of n-alkyl dimethyl benzyl ammonium chlorides.

17. A stable, aqueous cleaner/degreaser composition as set forth in claim 1 wherein said surfactant is an amphoteric surfactant selected from the group consisting of cocamidopropyl betaine, sodium palmityloamphopropionate, N-coco beta-aminopropionic acid, disodium N-lauryliminodipropionate, sodium coco imidazoline amphoglycinate and coco betaine.

18. A stable, aqueous cleaner/degreaser composition as set forth in claim 1 wherein said coupler is selected from the group consisting of sodium benzene sulfonate, sodium toluene sulfonate, sodium xylene sulfonate, potassium ethylbenzene sulfonate, sodium cumene sulfonate, sodium octane-1-sulfonate, potassium dimethylnaphthalene sulfonate, ammonium xylene sulfonate, sodium n-hexyl diphenyoxide disulfonate, sodium 2-ethylhexyl sulfate, ammonium n-butoxyethyl sulfate, sodium 2-ethylhexanoate, sodium pelargonate, sodium n-butoxymethyl carboxylate, potassium mono/di phenoxyethyl phosphate, sodium mono/di n-butoxyethyl phosphate, triethanolamine trimethylolpropane phosphate, sodium capryloamphopropionate, disodium capryloiminodipropionate, and sodium capro imidazoline amphoylycinate.

19. A stable, aqueous cleaner/degreaser composition as set forth in claim 1 wherein said microemulsion additionally comprises one or more optional adjuvants selected from the group consisting of chelants, thickeners, fragrances, dyes, pH adjustants, anti-corrosion additives, defoaming agents and anti-rust additives.

20. A stable, aqueous cleaner/degreaser composition as set forth in claim 1 wherein said organic solvent is 2-phenoxyethanol.

21. A stable, aqueous cleaner/degreaser composition as set forth in claim 1 wherein said organic solvent is 1-phenoxy-2-propanol.

22. A stable, aqueous cleaner/degreaser composition as set forth in claim 1 wherein said organic solvent is benzonitrile.

23. A stable, aqueous cleaner/degreaser composition as set forth in claim 1 wherein said organic solvent is benzaldehyde.

24. A stable, aqueous cleaner/degreaser composition as set forth in claim 1 wherein said organic solvent is cyclohexanone.

25. A stable, aqueous cleaner/degreaser composition as set forth in claim 1 wherein said organic solvent is isophorone.

26. A stable, aqueous cleaner/degreaser composition as set forth in claim 1 wherein said organic solvent is n-butoxyethyl acetate.

27. A stable, aqueous cleaner/degreaser composition as set forth in claim 1 wherein said organic solvent is β-phenylethanol 28. A stable, aqueous cleaner/degreaser composition as set forth in claim 1 wherein said organic solvent is benzyl alcohol.

29. A stable, aqueous cleaner/degreaser composition as set forth in claim 1 wherein said surfactant is dodecylbenzenesulfonic acid.

30. A stable, aqueous cleaner/degreaser composition as set forth in claim 1 wherein said surfactant is octylphenoxypoly(ethyleneoxy)(11)ethanol.

31. A stable, aqueous cleaner/degreaser composition as set forth in claim 1 wherein said surfactant is nonylphenoxypoly(ethyleneoxy)(13)ethanol.

32. A stable, aqueous cleaner/degreaser composition as set forth in claim 1 wherein said coupler is sodium xylene sulfonate.

33. A stable, aqueous cleaner/degreaser composition as set forth in claim 1 wherein said coupler is sodium cumene sulfonate.

34. A stable, aqueous cleaner/degreaser composition as set forth in claim 1 wherein said microemulsion additionally comprises an alkanolamine as an anti-rust additive.

35. A stable, aqueous cleaner/degreaser composition as set forth in claim 34 wherein said alkanolamine is monoethanolamine.

36. A stable, aqueous cleaner/degreaser composition in the form of a microemulsion comprising:

(a) 1-phenoxy-2-propanol in an amount exceeding its aqueous solubility;

(b) from approximately 0.25 wt. % to 10.0 wt. % of sodium metasilicate;

(c) dodecylbenzenesulfonic acid in an amount not substantially exceeding the amount required to transform the combination of said 1-phenoxy-2-propanol and sodium metasilicate from the form of a true macroemulsion to the form of a microemulsion and less than that required to form a true solution; and (d) water.

37. A stable, aqueous cleaner/degreaser composition in the form of a microemulsion comprising;

(a) 1-phenoxy-2-propanol in an amount exceeding its aqueous solubility;

(b) from approximately 0.25 wt. % to 10.0 wt. % of tetrapotassium pyrophosphate;

(c) dodecylbenzenesulfonic acid in an amount not substantially exceeding the amount required to transform the combination of said 1-phenoxy-2-propanol and tetrapotassium pyrophosphate from the form of a true macroemulsion to the form of a microemulsion and less than that required to form a true solution; and (d) water.

38. A stable, aqueous cleaner/degreaser composition in the form of a microemulsion comprising;

(a) 1-phenoxy-2-propanol in an amount exceeding its aqueous solubility;

(b) from approximately 0.25 wt. % to 10.0 wt. % of sodium carbonate;

(c) dodecylbenzenesulfonic acid in an amount of substantially exceeding the amount required to transform the combination of said 1-phenoxy2-propanol and sodium carbonate from the form of a true macroemulsion to the form of a microemulsion and less than that required to form a true solution; and (d) water.

39. A stable, aqueous cleaner/degreaser composition in the form of a microemulsion comprising;

(a) 1-phenoxy-2-propanol in an amount exceeding its aqueous solubility;

(b) from approximately 0.25 wt. % to 10.0 wt. % of borax;

(c) dodecylbenzenesulfonic acid in an amount of substantially exceeding the amount required to transform the combination of said 1-phenoxy-2-propanol and borax from the form of a true macroemulsion to the form of a macroemulsion and less than that required to form a true solution; and (d) water.

40. A stable, aqueous cleaner/degreaser composition as set forth in claim 37 further comprising monoethanolamine.

* * * * *